United States Patent [19]

Honegger

[11] Patent Number: 4,793,566

[45] Date of Patent: Dec. 27, 1988

[54] METHOD AND APPARATUS FOR FORMING MULTI-LAYER COILS FROM SUBSTANTIALLY FLAT, FLEXIBLE PRODUCTS, ESPECIALLY PRINTED PRODUCTS, ARRIVING IN IMBRICATED PRODUCT FORMATION

[75] Inventor: Werner Honegger, Tann-Rüti, Switzerland

[73] Assignee: Ferag AG, Hinwil, Switzerland

[21] Appl. No.: 922,257

[22] Filed: Oct. 23, 1986

Related U.S. Application Data

[63] Continuation of Ser. No. 649,370, Sep. 11, 1984, abandoned.

[30] Foreign Application Priority Data

Sep. 19, 1983 [CH] Switzerland ..... 5067/83

[51] Int. Cl.[4] ..... B65H 75/00

[52] U.S. Cl. ..... 242/59

[58] Field of Search ..... 242/59, 55, 76, 55.2, 242/67.3 R, 67.1 R; 271/151, 202, 216, 303, 37, 38; 53/118, 430; 270/52, 54, 56; 198/347, 423, 461, 462, 778; 414/29, 31, 40, 129, 130

[56] References Cited

U.S. PATENT DOCUMENTS

| | | | |
|---|---|---|---|
| 2,925,167 | 2/1960 | Lindberg | 198/462 |
| 3,671,035 | 6/1972 | Reist | 271/202 |
| 3,749,330 | 7/1973 | Gazzola | 242/67.3 R |
| 3,842,719 | 10/1974 | Fernandez-Rana et al. | 271/216 X |

FOREIGN PATENT DOCUMENTS

| | | | |
|---|---|---|---|
| 54735 | 6/1982 | European Pat. Off. | 53/118 |
| 34662 | 1/1965 | German Democratic Rep. | 271/216 |

*Primary Examiner*—John M. Jillions
*Attorney, Agent, or Firm*—Werner W. Kleeman

[57] ABSTRACT

Before winding-up the printed products arriving in imbricated product formation, the thickness of the imbricated product formation travelling toward a winding mandrel, respectively toward a product coil or package forming thereupon, is regulated to a prescribed value. This is effected by spreading or compacting the printed products within the imbricated product formation. For this purpose a first conveyor device is driven at higher or lower speed than a second preceding conveyor device. The imbricated product formation of prescribed thickness is wound-up upon the winding mandrel together with a winding strap maintained under tension which always lies upon the outer side of the coil layer being formed. By regulating the thickness of the imbricated product formation to be wound-up so as to have a prescribed value which remains essentially constant throughout the winding-up procedure, it is possible to form product coils of essentially constant diameter with a prescribed constant length of winding strap independently of the thickness of the arriving printed products.

9 Claims, 2 Drawing Sheets

METHOD AND APPARATUS FOR FORMING MULTI-LAYER COILS FROM SUBSTANTIALLY FLAT, FLEXIBLE PRODUCTS, ESPECIALLY PRINTED PRODUCTS, ARRIVING IN IMBRICATED PRODUCT FORMATION

CROSS REFERENCE TO RELATED APPLICATION

This application is a continuation of my commonly assigned copending U.S. patent application Ser. No. 06/649,370, filed Sept. 11, 1984 and entitled "METHOD AND APPARATUS FOR FORMING MULTI-LAYER COILS FROM SUBSTANTIALLY FLAT, FLEXIBLE PRODUCTS, ESPECIALLY PRINTED PRODUCTS, ARRIVING IN IMBRICATED PRODUCT FORMATION", now abandoned.

BACKGROUND OF THE INVENTION

The present invention broadly relates to the formation of multi-layer coils of substantially flat products and, more specifically, pertains to a new and improved method and apparatus for forming multi-layer coils from substantially flat, flexible products, especially printed products, arriving in imbricated product formation.

Generally speaking, the method of the present invention is one in which the flat products are wound-up together with a winding strap upon a winding mandrel with the winding strap lying on an outer side of the coil layer being formed.

The apparatus of the present invention comprises a drivably and rotatably journaled winding mandrel or core defining a winding drum, first conveyor means for conducting the flat products to a product coil forming on the winding mandrel and a winding strap or band capable of being connected with the winding mandrel and of being wound-up together with the flat products on an outer side of a coil layer being formed.

An apparatus of this type is known from the German Patent Publication No. 3,123,888, corresponding to U.S. Pat. No. 4,438,618, issued March 27, 1984, in which the printed products arriving in imbricated product formation are wound-up upon a winding mandrel or core together with a winding band or strap withdrawn from a supply roll and supporting from below the imbricated product formation to be wound-up. At the end of the winding procedure, the winding band or strap is wound around the completed coil or wound package one or more times such that each new layer of the winding band or strap overlies the previous layer of winding band or strap. The friction between the superposed layers of winding band or strap suffices to hold the wound product coil or package together.

It is well known that, for a given diameter of the product coil or wound package, the length of the wound-up imbricated product formation, and therefore the necessary length of winding band or strap, depends upon the thickness of the flat products. This means that in product coils or wound packages of constant diameter various lengths of winding band or strap are required. For this reason, in order to be able to form a product coil or package of the desired size in every case, the supply roll must always contain a sufficient amount of winding band or strap. It can therefore occur that, after completing a product coil or wound package, a remainder of winding band or strap remains upon the supply roll. In principle, various possibilities are available for handling this remainder.

For instance, the remaining length of winding band or strap can be wound around the completed product coil or wound package. However, this delays the completion of the product coil or wound package by a time interval dependent upon the length of the remaining winding band or strap. Furthermore, the coil diameter becomes greater by the amount of the additional layers of winding band or strap.

It is also possible to sever the winding band or strap after completion of the product coil or wound package and to leave the remainder of the winding band or strap on the supply roll. Such a procedure leads, however, to problems when the winding band or strap is to be reused for forming a new product coil after the flat products have been wound-off the winding mandrel. For the previously explained reasons it can occur that the winding band or strap previously shortened by severing the remainder is no longer sufficiently long for forming a new product coil which then requires a time-consuming splicing of winding band or strap segments.

It is further conceivable to leave the remainder of the winding band or strap on the supply roll and to transport and store the latter with the associated completed product coil or wound package. This is, however, a most inconvenient procedure in manipulation and also requires manual labor.

It has been proposed to avoid this disadvantage by mounting the winding mandrel and the supply roll for the winding band or strap in a common mobile frame in which both the winding mandrel and the supply roll permanently remain (cf. German Patent Publication No. 3,236,866, corresponding to the commonly assigned, copending U.S. patent application Ser. No. 06/432,557, filed Oct. 4, 1982, now U.S. Pat. No. 4,587,790, granted May 13, 1986). The winding band or strap is always connected with the winding mandrel, on the one hand, and with the supply roll, on the other hand, which means that any remaining winding band or strap present remains stored upon the supply roll. As long as a winding band or strap of a length sufficient for the greatest consumption of winding band or strap foreseen in service remains wound-up on the supply roll, product coils or wound packages formed from printed products of varying thicknesses can be produced with this known apparatus without difficulty. Nevertheless, a substantial construction outlay and a sufficiently great supply of winding band or strap, which in certain cases exceeds requirements, is necessary.

It is also known to arrange the supply roll for the winding band or strap within the interior of the winding mandrel and to unroll the length of winding band or strap required for the formation of the product coil or wound package from the supply roll and to wind it up upon a storage roll outside the winding mandrel before winding-up (cf. German Patent Publication No. 3,231,427 corresponding to the commonly assigned, copedding U.S. patent application Ser. No. 06/412,843, filed Aug. 30, 1982, now U.S. Pat. No. 4,532,750, granted Aug. 6, 1985). In this execution there is therefore always the proper length of winding band or strap available but, on the other hand, there is also a considerable construction outlay and the presence of a stored length of winding band or strap sufficiently great for all applications, i.e. the worse case, is necessary.

SUMMARY OF THE INVENTION

Therefore, with the foregoing in mind, it is a primary object of the present invention to provide a new and improved method and apparatus for forming multi-layer coils from substantially flat, flexible products, especially printed products, arriving in imbricated product formation which does not exhibit the aforementioned drawbacks and shortcomings of the prior art constructions.

Another and more specific object of the present invention aims at providing a new an improved method and apparatus for forming multi-layer coils of the previously mentioned type which permit the formation of product coils of a prescribed diameter from flat products of various thicknesses without requiring great construction outlay in order to always provide a sufficiently great length of winding band or strap for each case.

Yet a further significant object of the present invention aims at providing a new and improved apparatus for forming multi-layer coils of the character described which is relatively simple in concept, extremely economical to realize, highly reliable in operation, not readily subject to malfunction and requires a minimum of attention.

Now in order to implement these and still further objects of the invention which will become more readily apparent as the description proceeds, the method of the present invention is manifested by the features that it comprises the steps of regulating, before winding-up, the thickness of the imbricated product formation to be wound-up so as to have a prescribed value which remains essentially constant throughout the formation of the product coil by increasing or decreasing, i.e. by appropriately altering, the given imbrication pitch of the flat products within the imbricated product formation.

The apparatus of the present invention is manifested by the features that it comprises means for regulating the delivered formation thickness of the imbricated product formation to be wound-up so as to have a prescribed value which remains essentially constant throughout the formation of the product coil by increasing or decreasing, i.e. by appropriately altering, the imbrication pitch of the flat products within the imbricated product formation.

By regulating the delivered formation thickness of the imbricated product formation to be wound-up so as to assume a prescribed value by altering the given imbrication pitch before winding-up, the effect is achieved that each coil layer has essentially the same radial dimension independently of the thickness of the arriving printed products. This means that product coils of a prescribed and constant diameter can be formed from printed products of various thicknesses with a constant length of winding band or strap. The problem of supplying a length of winding band or strap appropriate for a particular thickness of arriving products or of disposing of a possible remainder of winding band or strap therefore does not arise. The length of winding band or strap requisite for the desired coil diameter can be determined and prepared once and for all.

The formation of imbricated product formations of equal thicknesses before winding-up is preferably effected by increasing or decreasing the speed of the printed products approaching the product coil forming upon the winding mandrel with respect to their original conveying speed.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
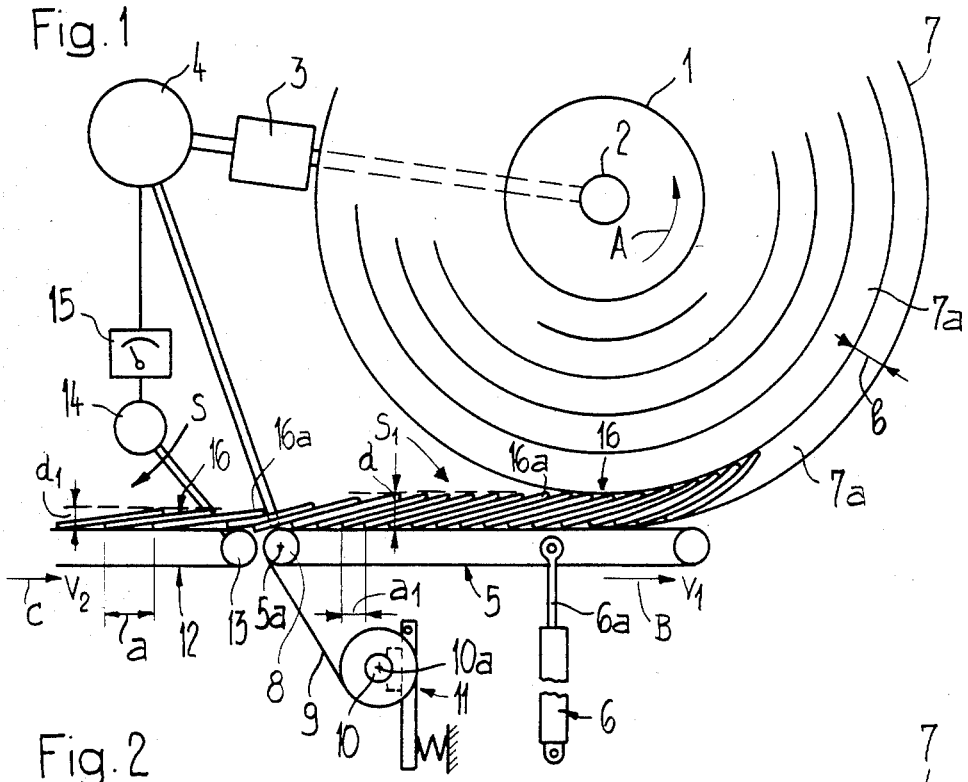
FIGS. 1 and 2 schematically illustrate an apparatus for forming product coils or wound packages of a prescribed diameter from products of various thicknesses.

Describing now the drawings, it is to be understood that to simplify the showing thereof only enough of the structure of the apparatus for forming multi-layer coils from substantially flat, flexible products, especially printed products, arriving in imbricated product formation has been illustrated therein as is needed to enable one skilled in the art to readily understand the underlying principles and concepts of this invention. Turning now specifically to FIG. 1 of the drawings, the apparatus illustrated therein by way of example and not limitation and employed to realize the method as hereinbefore described will be seen to comprise a substantially cylindrical winding mandrel or core 1 whose shaft 2 is driven in the direction of the arrow A by a drive motor 4 through a winding gearing 3. This apparatus basically corresponds in construction and in operation to the apparatus described in the previously mentioned German Patent Publication No. 3,123,888 and the corresponding British Patent Publication No. 2,081,230, both corresponding to the aforementioned U.S. Pat. No. 4,438,618.

The winding gearing 3 is of a known type of construction and is preferably a winding gearing such as is commercially available from the company Antrieb Werner Reimers KG. A first conveyor device 5 constructed as a belt conveyor is arranged beneath the winding mandrel or core 1. The conveyor device 5 is further constructed as a balance or rocker arm to pivot about an axis or shaft 5*a*.

A spring-loaded pressure rod 6*a* of a pressure or contact mechanism 6 engages the conveyor device 5 and presses this conveyor device 5 against the winding mandrel or core 1, respectively against the product coil or wound package 7—briefly sometimes just referred to as simply coil—forming thereupon. The conveyor device 5 comprises a drive roll 8 which is operatively connected with the drive motor 4 and which is driven by this drive motor 4 through the conveyor device 5 in the direction of the arrow B at the conveying speed $v_1$.

A winding band or strap 9 is conducted over this drive roll 8. The winding band or strap 9 is connected at one of its ends with the winding mandrel or core 1 and is withdrawn from a supply roll 10 which is freely rotatably journaled about an axis or shaft 10*a*. A suitable braking device 11 shown only schematically in FIG. 1, engages this supply roll 10 and, in the exemplary embodiment illustrated, is constructed as a shoe or friction brake.

A second conveyor device 12, which is also constructed as a belt conveyor, precedes the first conveyor device 5. The second conveyor device 12 has a conveying direction C which coincides with the conveying direction B of the first conveyor device 5. The second conveyor device 12 is driven by any suitable, not particularly shown drive means at a delivery speed $v_2$. A deflection or return roll 13 of the second conveyor device 12 is connected with a tacho-generator 14 which, in turn, is connected with a manually operable regulating device 15 for the drive motor 4.

The second conveyor device 12 serves to deliver printed products 16 arriving in an imbricated product formation S and, for instance, output by a rotary printing press or rotogravure machine, at the delivery speed $v_2$. As seen in the conveying direction C of the conveyor device 12, the leading edges 16*a*, which are usually the folded edges, lie upon the upper side or face of the imbricated product formation S. The given imbrication pitch, i.e. the distance between the printed products 16 within the delivered imbricated product formation S, is designated with the reference character a.

Figure 2:
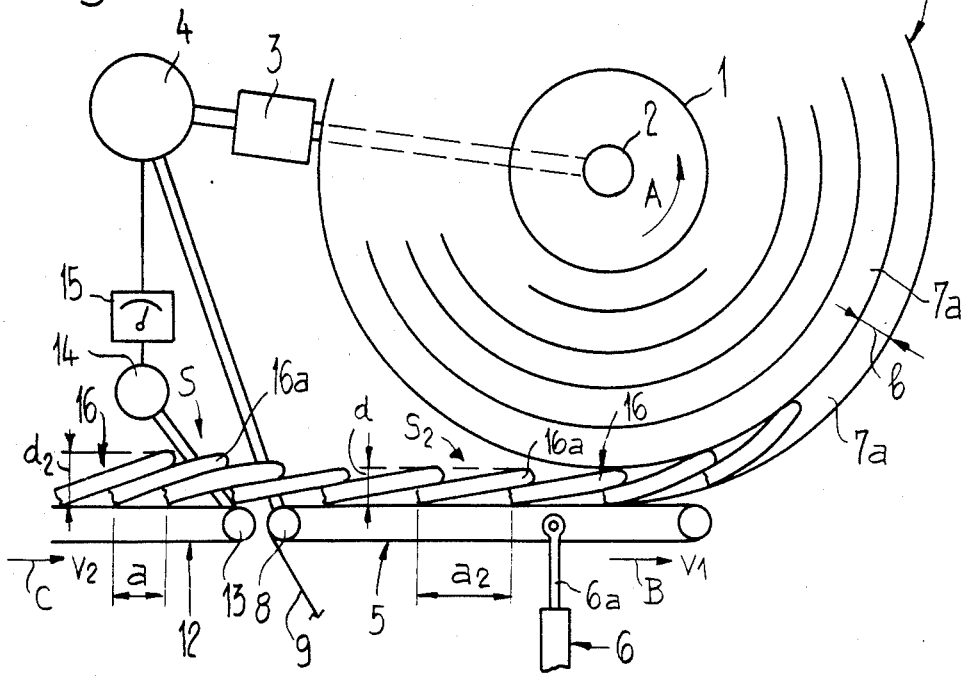

The apparatus illustrated in FIGS. 1 and 2 makes it possible to form a coil or wound package 7 of a given or prescribed constant diameter with a constant length of winding band or strap 9, independently of the thickness of the arriving printed products 16. In order to realize this effect, the present invention ensures, in a manner to be described hereinbelow, that the radial dimension b of the individual coil layers 7*a*, which are indicated schematically in FIGS. 1 and 2, remains constant in every winding-up procedure, independently of the thickness of the arriving printed products 16. This means that the thickness d of the imbricated product formation $S_1$, respectively $S_2$, approaching the winding mandrel or core 1, respectively th coil or wound package 7, is so regulated that it essentially retains a prescribed value throughout the entire winding-up procedure. This is accomplished by altering the imbrication pitch as will now be explained in th following in relation to FIGS. 1 and 2.

As already mentioned, the thickness of the imbricated product formation $S_1$, respectively $S_2$, must always have the prescribed value d independently of the thickness $d_1$, respectively $d_2$, of the imbricated product formation S delivered by th second conveyor device 12. The case of an imbricated product formation S composed of thin printed products 16 is illustrated in FIG. 1. Its delivered formation thickness $d_1$ is less than the required thickness d. Now in order to obtain this prescribed value or thickness d the arriving printed products 16 must be pushed together or compacted, i.e. condensed, which means that the original imbrication pitch a is decreased to the imbrication pitch $a_1$. In order to obtain such a decrease in the imbrication pitch, the conveyor device 5 is driven at a conveying speed $v_1$ which is less than the delivery speed $v_2$ of the preceding conveyor device 12. The relation between the conveying speeds $v_1$ and $v_2$ corresponds to the ratio of the thicknesses d and $d_1$.

The opposite case is described in FIG. 2 in which the delivered imbricated product formation flow or stream S is formed by thick printed products 16, so that the delivered formation thickness $d_2$ of the delivered imbricated product formation S is greater than the thickness d required for winding-up. This means that the printed products 16 must be drawn apart or spread, i.e. fanned out, within their imbrication formation before winding-up. This leads to an increase in the imbrication pitch from a to $a_2$ In order to obtain such an increase in the imbrication pitch, the first conveyor device 5 is driven at a conveying speed $v_1$ which is greater than the delivery speed $v_2$ of the preceding or second conveyor device 12. In this case, too, the ratios of the conveying speeds $v_1$ and $v_2$ and of the thicknesses d and $d_2$ of the imbricated product formations S and $S_2$ correspond to one another. It will be understood that the conveying speed $v_1$ of the conveyor device 5 must correspond to the delivery speed $v_2$ of the imbricated product formation S if the thickness of the delivered imbricated product formation S already corresponds to the nominal thickness d.

The adaptation of the conveying speed $v_1$ of the conveyor device 5 to the thickness $d_1$, respectively $d_2$, of the arriving imbricated product formation S described above is effected by an appropriate alteration of the rotary drive speed of the drive motor 4 by means of the regulation device 15. In this manner the rotary drive speed of the drive roll 8 is altered and, via the winding gearing 3, that of the winding mandrel or core 1 as well. Any variations of the delivery speed $v_2$ of the conveyor device 12 which call for an appropriate adaptation of the rotary drive speed of the drive motor 4 are detected by the tacho-generator 14 and are input to the regulating device 15. It will be understood that the adjustment of the requisite conveying speed $v_1$ of the conveyor device 5 can also be effected automatically instead of manually.

The imbricated product formations $S_1$ and $S_2$having, as described, a prescribed thickness d are conveyed or delivered to the winding mandrel or core 1, respectively the coil or wound package 7 being formed thereupon, with the leading edges 16*a* of the printed products 16 oriented toward the winding mandrel or core 1, respectively toward the coil or wound package 7 forming thereupon, and are wound-up upon the winding mandrel or core 1 driven by the drive motor 4 together with the winding band or strap 9, as is described in the previously mentioned German Patent Publication No. 3,123,888 and the corresponding British Patent Publication No. 2,081,230, both corresponding to the aforementioned U.S. Pat. No. 4,438,618. The winding band or strap 9, which is connected with the winding mandrel or core 1, on the one hand, and is withdrawn from the supply roll 10 by the drive roll 8, on the other hand, is placed under tension. By braking this supply roll 10, it is ensured that the winding band or strap 9 lies tightly against the drive roll 8. By winding-up the imbricated product formation $S_1$ and $S_2$ with the leading edges 16*a* of the printed products 16 oriented toward the coil or wound package 7, respectively toward the winding mandrel or core 1, together with the winding band or strap 9 maintained under tension, a compact product coil or package of large diameter is obtained.

Since each coil layer 7*a* always has the same radial dimension b independently of the thickness of the printed products 16, a constant length of winding band or strap is always required for a coil or wound package 7 of a prescribed diameter. In other words, it is always possible to form product coils of a prescribed diameter from imbricated product formations of different thicknesses with a given length of winding band or strap. The requisite length of winding band or strap and also the diameter of the coil can be determined in advance for each case so that the problems of insufficient length of winding band or strap or a superfluous remainder of winding band or strap do not arise.

Figure 3:
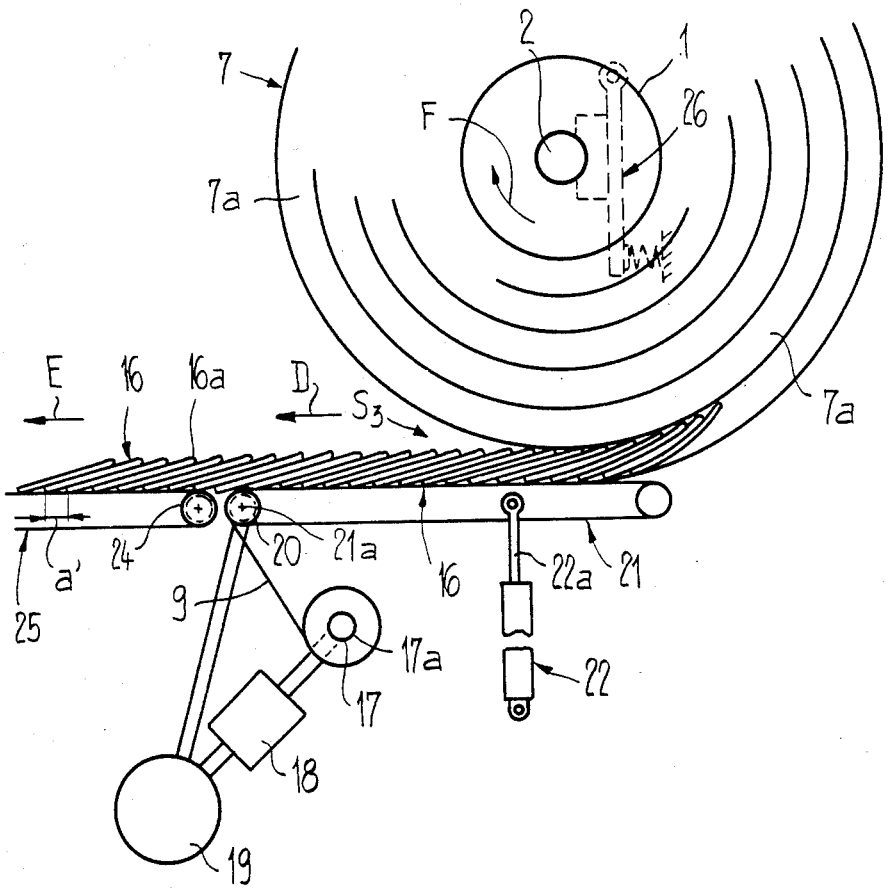
FIG. 3 schematically illustrates an apparatus for unwinding the imbricated product formation from a product coil or package formed by means of the apparatus according to FIGS. 1 and 2.

An apparatus for unwinding the printed products 16 from the product coil or wound package 7 formed in the manner described in relation to FIGS. 1 and 2 is illustrated in FIG. 3. This unwinding apparatus comprises a winding roll 17 for the winding band or strap 9. The winding roll 17 is rotatably journaled about its axis or shaft 17*a* and is connected with a drive motor 19 by a winding gearing 18. The winding gearing 18 corresponds to the winding gearing 3 of the apparatus according to FIGS. 1 and 2. The drive motor 19 also drives a drive roll 20 of a first conveyor device 21 constructed as a belt conveyor and arranged beneath the winding mandrel or core 1 to be pivotable about an axis or shaft 21*a*. A spring-loaded pressure rod 22*a* of a pressure or contact mechanism 22 engages this conveyor device 21 and presses the conveyor device 21 against the product coil or wound package 7. The winding band or strap 9 is conducted over the drive roll 20. The drive roll 20 drives a deflection or return roll 24 of a second conveyor device 25 by a dive element 23, for instance a drive chain.

The second conveyor device 25 is also constructed as a belt conveyor. The conveying direction E of this second conveyor device 25 corresponds to the conveying direction D of the preceding or first conveying device 21. A braking or brake device 26, shown only schematically in FIG. 3, engages the shaft 2 of the winding mandrel or core 1 and, in the exemplary embodiment illustrated, is constructed as a shoe or friction brake of known type.

Driving the drive roll 20 results in a rotation of the winding mandrel or core 1 in the direction of the arrow F as well as in an unwinding of the printed products 16. The printed products 66 are conveyed away by the conveyor devices 21 and 25 in an imbricated product formation $S_3$. The simultaneously unwound winding band or strap 9 is wound-up on the driven winding roll 17. The drive motor 19 drives the winding roll 17 as well as the drive roll 20 through the winding gearing 18 such that in cooperation with the braking of the shaft 2 of the winding mandrel or core 1, it generates a tension force in the winding band or strap 9. Otherwise the unwinding procedure is effected in the manner described in the previously mentioned German Patent Publication No. 3,123,888, corresponding to the British Patent Publication No. 2,081,230, both corresponding to the aforementioned U.S. Pat. No. 4,438,618.

In the embodiment shown in FIG. 3, no alteration of the imbrication pitch a' is effected, so that it corresponds to the imbrication pitch $a_1$, respectively $a_2$, which was previously regulated in the manner described in relation to FIGS. 1 and 2. This means that, as a rule, the imbrication pitch a' in the unwound imbricated product formation $S_3$ no longer corresponds to the imbrication pitch a in the originally arriving imbricated product formation S. It is however possible to reconstitute the original imbrication pitch a in a manner similar to that described in relation to FIGS. 1 and 2 by fanning-out or condensing the unwound printed products 16, as the case may be. For this purpose the second conveyor device 25 would have to be driven at a conveying speed which is either greater or less than the conveying speed of the first conveyor device 21. This would also mean that the second conveyor device 25 would have to be driven independently of the first conveyor device 21.

While there are shown and described present preferred embodiments of the invention, it is to be distinctly understood that the invention is not limited thereto, but may be otherwise variously embodied and practiced within the scope of the following claims. Accordingly,

What I claim is:

1. A method for forming a multi-layer coil from printed products, each having a given product thickness and delivered in an imbricated product formation having a given imbrication pitch and a delivered formation thickness conjointly determined by said product thickness and said imbrication pitch, comprising the steps of:

regulating, before winding-up the products into a coil, said delivered formation thickness of said imbricated product formation to be wound-up so as to have a prescribed value which remains essentially constant throughout the formation of said coil, by increasing or decreasing the given imbrication pitch of said products within said imbricated product formation as a function of the given product thickness;

winding-up said products together with a winding strap upon a winding mandrel to form said coil so as to have a multiplicity of coil layers having a radial dimension corresponding to said prescribed value; and said winding strap lying on an outer face of a coil layer being formed.

2. The method as defined in claim 1, wherein:

during said step of increasing or decreasing the given imbrication pitch of said products within said imbricated product formation, respectively decreasing or increasing the speed of said imbricated formation to be wound up on said coil being formed upon said winding mandrel with respect to the speed of said delivered imbricated product formation.

3. The method as defined in claim 1, further including the step of:

delivering said imbricated product formation to be wound up on said coil being formed on said winding mandrel with leading edges of each product in said imbricated product formation to be wound up closer to said winding mandrel than trailing edges of said products.

4. The method as defined in claim 1, further including the step of:

maintaining sad winding strap under tension.

5. In a method for forming a multi-layer oil from substantially flat, flexible products, especially printed products, each having a predetermined product thickness and delivered in an imbricated product formation having a given imbrication pitch and a delivered formation thickness conjointly determined by said product thickness and said imbrication pitch, comprising the steps of:

regulating, before winding-up the products into a coil, said delivered formation thickness of said imbricated product formation to be wound-up so as to possess a prescribed value different from said delivered formation thickness and which remains essentially constant throughout the formation of said coil by appropriately altering the given imbrication pitch of said products within said imbricated product formation as a function of the predetermined product thickness.

6. A method for forming a multi-layer coil of predetermined diameter from substantially flat, flexible products each having a predetermined product thickness and delivered in an imbricated product formation having a predetermined imbrication pitch and a delivered formation thickness conjointly determined by said product thickness and said imbrication pitch, comprising the steps of:

reducing said predetermined imbrication pitch of said delivered imbricated product formation before winding-up said substantially flat, flexible products, into said multi-layer coil such that said delivered formation thickness is increased to a prescribed value; and winding-up said substantially flat, flexible products conjointly with a winding strap of predetermined length upon a winding mandrel to form said multi-layer coil with coil layers having a radial dimension substantially equal to said prescribed value and such that said winding strap lies on an outer face of each coil layer and is consumed substantially without remainder and substantially without shortage when said predetermined diameter is attained.

7. A method for forming a multi-layer coil of predetermined diameter from substantially flat, flexible products each having a predetermined product thickness and delivered in an imbricated product formation having a predetermined imbrication pitch and a delivered formation thickness conjointly determined by said product thickness and said imbrication pitch, comprising the steps of:

increasing said predetermined imbrication pitch of said delivered imbricated product formation before winding-up said substantially flat, flexible products, into said multi-layer coil such that said delivered formation thickness is reduced to a prescribed value; and winding-up said substantially flat, flexible products, conjointly with a winding strap of predetermined length upon a winding mandrel to form said multi-layer coil with coil layers having a radial dimension substantially equal to said prescribed value and such that said winding strap lies on an outer face of each coil layer and is consumed substantially without remainder and substantially without shortage when said predetermined diameter is attained.

8. An apparatus for forming a multi-layer coil of predetermined diameter from substantially flat, flexible products each having a predetermined product thickness and delivered at a predetermined delivery speed in an imbricated product formation having a predetermined imbrication pitch and a delivered formation thickness conjointly determined by said product thickness and said imbrication pitch, comprising:

a rotatably journaled winding mandrel for said multi-layer coil;

conveyor means for conducting said substantially flat, flexible products to said multi-layer coil being formed on said winding mandrel;

a winding strap of predetermined length releasably connected to said winding mandrel for being wound-up into said multi-layer coil being formed on said winding mandrel on an outer face of a coil layer being formed;

adjustable speed drive means for continuously driving said winding mandrel at a rotary drive speed and said conveyor means at a conveying speed matched to said rotary drive speed;

control means for adjusting said adjustable speed drive means such that a ratio of said conveying speed of said conveyor means to said predetermined delivery speed of said substantially flat, flexible products is substantially equal to a ratio of said delivered formation thickness to a prescribed value for a radial dimension of said coil layer; and said prescribed value of said radial dimension, said predetermined length of said winding strap and said predetermined diameter of said multi-layer coil being interrelated such that said winding strap is consumed substantially without remainder or shortage when said predetermined diameter is attained.

9. A method of forming a multi-layer coil from an imbricated product formation containing substantially flat, flexible products, especially printed products, said method comprising the steps of:

delivering an imbricated product formation having an undesired imbricated product formation thickness determined conjointly by the thickness and the pitch of the products in said delivered imbricated product formation;

forming from said delivered imbricated product formation having said undesired imbricated product formation thickness, in imbricated product formation to be wound-up and having a prescribed, substantially constant imbricated product formation thickness;

said step of forming said imbricated formation to be wound-up, entailing the step of regulating and thereby maintaining substantially constant the imbricated product formation thickness of said imbricated product formation to be wound-up by varying the pitch of said products in said delivered imbricated product formation as a function of said thickness of said products in said delivered imbricated product formation;

winding up said imbricated product formation to be wound-up upon winding mandrel and thereby forming, as said multi-layer coil, a multi-layer coil containing a predetermined multiplicity of layers, with all of the multiplicity of layers having substantially equal and constant radial dimensions corresponding to said prescribed substantially constant imbricated product formation thickness; and during said step of winding up said imbricated product formation to be wound-up, winding up a predetermined length of a winding strap such that said winding strap lies on an outer face of each one of said multiplicity of layers in said multi-layer coil and the predetermined length of the winding strap is consumed substantially without shortage and without remainder.

* * * * *

UNITED STATES PATENT AND TRADEMARK OFFICE

CERTIFICATE OF CORRECTION

PATENT NO. : 4,793,566

DATED : DECEMBER 27, 1988

INVENTOR(S) : WERNER HONEGGER

It is certified that error appears in the above-identified patent and that said Letters Patent is hereby corrected as shown below:

Column 2, line 61, please delete "copedding" and insert --copending--

Column 3, line 12, please delete "an" and insert --and--

Column 5, line 39, after "respectively" please delete "th" and insert --the--

Column 5, line 43, after "in" (first occurrence) please delete "th" and insert --the--

Column 7, line 24, after "a" (second occurrence) please delete "dive" and insert --drive--

Column 7, line 38, please delete "66" and insert --16--

Column 8, line 52, after "maintaining" please delete "sad" and insert --said--

Column 8, line 53, after "multi-layer" please delete "oil" and insert --coil--

Column 10, line 34, after "thickness," please delete "in" and insert --an--

Signed and Sealed this

Fourth Day of July, 1989

*Attest:*

*Attesting Officer*

DONALD J. QUIGG

*Commissioner of Patents and Trademarks*